United States Patent [19]

Frye et al.

[11] Patent Number: 4,598,849

[45] Date of Patent: Jul. 8, 1986

[54] WEB GUIDING AND DECURLING APPARATUS

[75] Inventors: Kenneth G. Frye, Egremont; Arthur T. Karis, Lenox, both of Mass.

[73] Assignee: Beloit Corporation, Beloit, Wis.

[21] Appl. No.: 592,417

[22] Filed: Mar. 23, 1984

[51] Int. Cl.[4] ..... B65H 23/038; B65H 23/04

[52] U.S. Cl. ..... 226/21; 226/45; 226/180; 226/189; 226/190; 226/196

[58] Field of Search ..... 226/21, 22, 23, 16, 226/25, 44, 45, 189, 180, 190, 194, 196; 242/57, 57.1; 162/197, 271; 250/571, 548

[56] References Cited

U.S. PATENT DOCUMENTS

| | | | |
|---|---|---|---|
| 1,432,832 | 10/1922 | Brockett | 226/194 X |
| 2,070,505 | 2/1937 | Beck | 162/271 |
| 2,698,982 | 1/1955 | Smith et al. | 226/23 X |
| 2,976,924 | 3/1961 | Baxter, Jr. | 162/197 X |
| 3,044,228 | 7/1962 | Peterson | 162/197 X |
| 3,366,298 | 1/1968 | Bahrani | 226/25 X |
| 3,373,288 | 3/1968 | Otepka et al. | 226/21 X |
| 3,510,036 | 5/1970 | Lewis, Jr. et al. | 226/25 X |
| 3,724,732 | 4/1973 | Bonner | 226/21 |
| 3,774,831 | 11/1973 | Paradine | 226/196 X |
| 3,831,828 | 8/1974 | Royon et al. | 226/16 |
| 3,913,729 | 10/1975 | Andrews | 226/23 X |
| 3,974,952 | 8/1976 | Swanke et al. | 226/189 |
| 4,033,492 | 7/1977 | Imai | 226/44 X |
| 4,069,959 | 1/1978 | Bartell et al. | 226/21 |
| 4,342,412 | 8/1982 | Lorenz et al. | 226/21 |
| 4,343,991 | 8/1982 | Fujiwara et al. | 250/548 X |
| 4,360,356 | 11/1982 | Hall | 162/271 X |
| 4,467,949 | 8/1984 | Nakata | 226/45 |
| 4,471,816 | 9/1984 | Wada | 250/271 X |

FOREIGN PATENT DOCUMENTS

| | | | |
|---|---|---|---|
| 806598 | 12/1958 | United Kingdom | 226/21 |

*Primary Examiner*—Harvey C. Hornsby
*Assistant Examiner*—Scott J. Haugland
*Attorney, Agent, or Firm*—Hill, Van Santen, Steadman & Simpson

[57] ABSTRACT

A paper web carrying apparatus is provided which combines a decurling apparatus, an edge sensing and compensating apparatus, a tension sensing apparatus and a slack edge compensation apparatus onto a single pivoting frame to increase the accuracy and lower the cost of directing paper web to a high speed sheeter. All of the components are either carried on the roller supporting pivot frame or an abutting support bracket.

12 Claims, 9 Drawing Figures

WEB GUIDING AND DECURLING APPARATUS

BACKGROUND OF THE INVENTION

1. Field of the Invention

The invention is directed to machinery for guiding and decurling webs of paper or paperboard to be fed into a high-speed, high production sheeter, and more particularly, relates to an apparatus which combines decurling, tension control and web guiding functions.

2. The Prior Art

In the paper-cutting machinery field, webs of paper or paperboard to be fed into a high-speed, high production sheeter require uniform tension, decurling to remove roll set or cross machine curl, and an edge guide to compensate for web wander, automatic splicing offsets or roll defects. These requirements are ordinarily met by separate devices located in the unwind and lead-in section of the sheeter. Much of the associated hardware of these devices is redundant. The separate locations also make the sheeter operation difficult to set up and operate, since adjustments at one location can upset the setting and operation of the other devices.

SUMMARY OF THE INVENTION

The present invention combines the separate tension controlling device, decurling device and web guiding device into a single unit located nearest to the sheeter where an operator can monitor and adjust all functions on all webs as the paper is drawn into the sheeter. This is particularly useful where multiple webs are drawn into the sheeter at one time.

A pivoting edge guide frame is used for carrying the paper web through the inventive device. Edge position error is sensed by a sensor and an error signal is fed through a proportional controller to an actuator which pivots the edge guide frame about the pivot bearing. Guide rollers at the top and the bottom of the frame keep the rotation in a uniform plane which displaces the web to its corrected position under the edge detector.

One end of the bottom roll shaft is pivoted and the opposite end is spring loaded to relieve weight and is provided with a threaded rod for vertical adjustment. This provides the function of compensating for a web with a slack edge by increasing the relative web path length on the slack or baggy side. Because the roll pivots in the vertical plane and also because the edge detector is after the pivoting roll, edge position is maintained with this design as opposed to previous configurations with a separate device for a slack edge adjustment.

The decurling function is incorporated into the top roll position. The web passes between a pair of slightly rounded bars, either of which can be rotated into the web by means of an electric motor and gear box to compensate for curl in either direction. Other types of decurling apparatus may also be utilized with the device of the present invention.

Web tension is sensed by an electric load cell which is loaded by a reaction force through the bottom beam. The beam is mounted in pivot bearings. Web tension creates a moment force about the pivots which is resisted by and is proporational to the reaction against the load cell. Tension sensed is independent of web position on the face of the roll which is an improvement over previous load cell arrangements. The arrangement also will lower costs by eliminating a fixed supporting frame which is usually part of a pivoting edge guide.

Therefore, with the substitution of automatic devices for slack edge compensation and decurling, the invention becomes part of a fully automatic system for web processing and control. Thus, the present invention provides an improvement over the prior art by providing functions and benefits not available from prior art devices.

DESCRIPTION OF THE PREFERRED EMBODIMENTS

Figure 1:
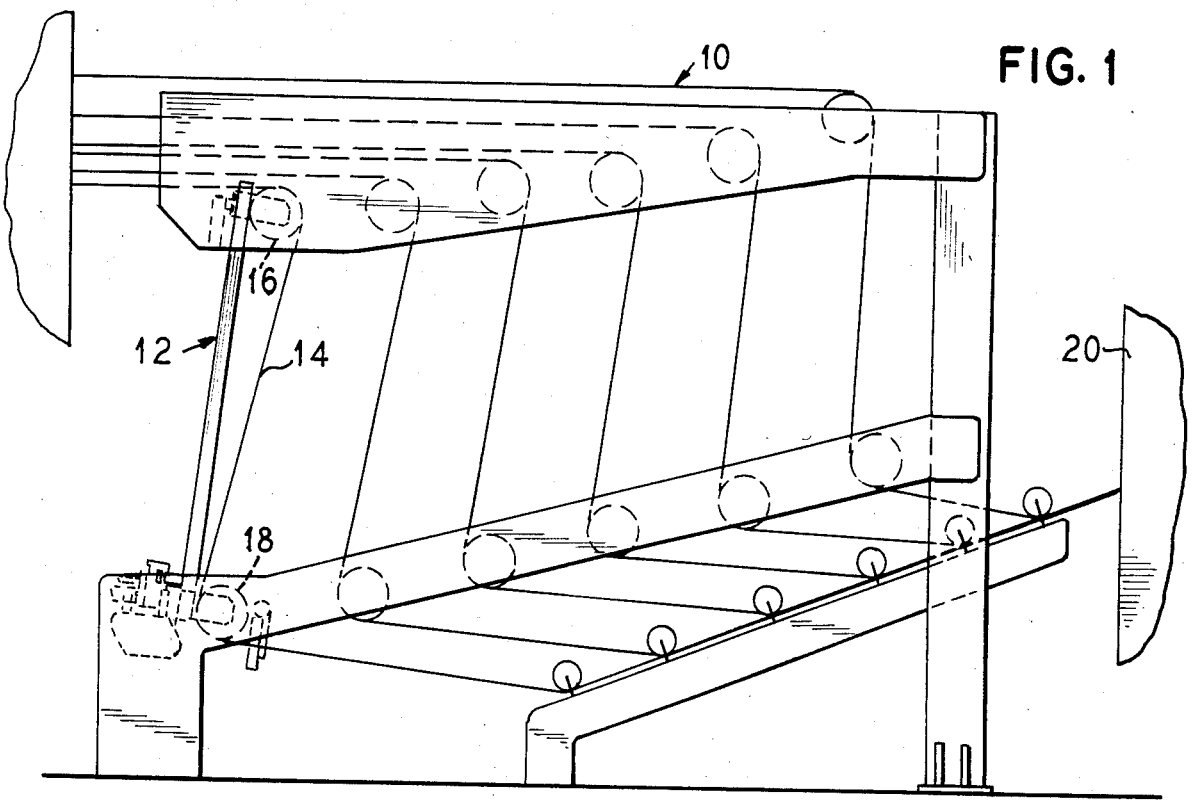
FIG. 1 is side elevational view of a web guiding and decurling apparatus incorporating the principles of the present invention.

FIG. 1 shows a web guiding, tensioning and decurling apparatus generally at 10 which is comprised of a combination of six individual and virtually identical apparatuses, one of such apparatuses being identified generally at 12. Six individual paper webs are fed through the apparatus, one of such webs being identified at 14. The webs are fed through the apparatus in an S-wrap by proceeding over a top roller 16 and under a bottom roller 18 on their way to a high-speed, high production sheeter 20. The webs 14 which are fed into the sheeter 20 require uniform tension, decurling to remove roll set or cross machine curl, and edge guiding to compensate for web wander, automatic splicing offsets or rolled defects. These requirements are met by the apparatus 12 which is shown in greater detail in FIGS. 2 through 5.

Figures 4, 5, 6, 7, 9:
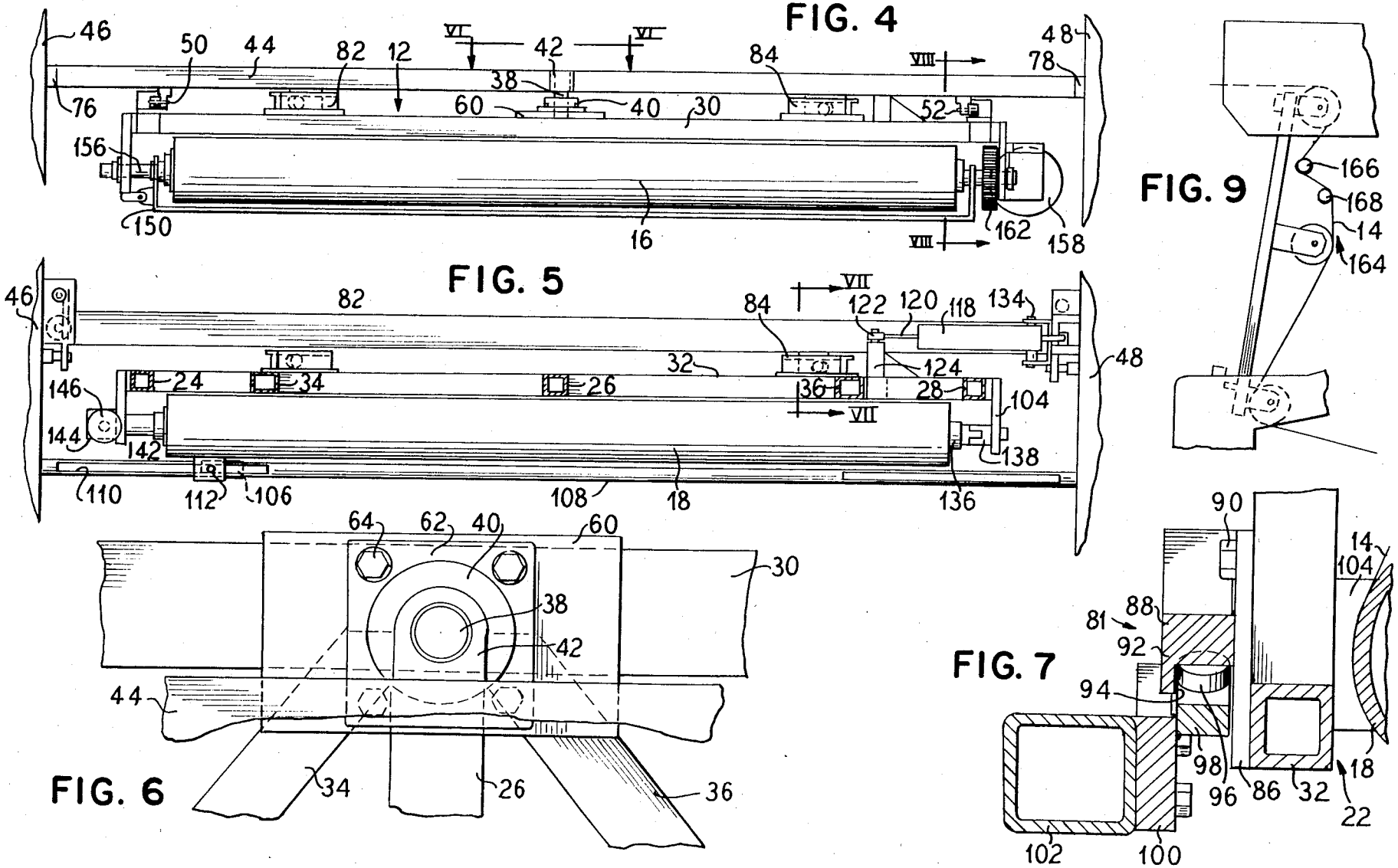
FIG. 4 is a top elevational view of the pivot frame shown in FIGS. 2 and 3.
FIG. 5 is a sectional view of the pivot frame taken generally along the lines V—V of FIG. 2.
FIG. 6 is a partial elevational view of the pivot area taken generally along the lines of VI—VI of FIG. 4.
FIG. 7 is a partial side sectional view of a lower guide roller assembly taken generally along the lines VII—VII of FIG. 2.
FIG. 9 is a schematic side elevational view of an alternative embodiment of a decurling device useful with the present invention.

The apparatus 12 is comprised of a guide frame 22 having three vertical support members 24, 26 and 28, two horizontal support members 30, 32 and two diagonal support members 34, 36. The guide frame is pivotally mounted, as seen in FIGS. 4 and 6, on a substantially horizontal pivot pin 38 which extends into a bearing means 40 mounted on the guide frame 22 at one end and into a second bearing means 42 in a support bracket 44 which is secured at its ends to two stationary walls 46, 48. Thus, the frame 22 can pivot in a substantially vertical plane about the horizontal pivot of pin 38. It should also be noted that the axis of rotation of the frame 22 about the pivot pin 38 is perpendicular to and intersects the axis of rotation of the top roller 16.

To ensure that the frame 22 remains in a substantially vertical orientation, two sets of roller assemblies are provided. Upper roller assemblies 50, 52, which are shown in greater detail in FIG. 8, comprise a roller mounting block 54 mounted directly to support bracket 44 which has a roller wheel 56 rotationally attached thereto. The roller wheel 56 is captured in a channel or race 58 which is in turn secured to the support member 30 of the frame 22. The engagement of the roller wheel 56 with the race 58 allows for pivotal movement of the frame 22 about the pivot pin 38 but prevents rotational movement of the frame around a vertical axis.

Referring to FIG. 6, it is seen that the top horizontal support means 30 has attached thereto a stiffening bracket 60 which connects and secures support members 26, 30, 34 and 36. The bearing 40 is secured to the plate 60 by means of a mounting plate 62 which can, for instance, capture a flange on the bearing 40. The mounting plate 62 is held against the plate 60 by appropriate fastening means such as bolts 64.

Figure 8:
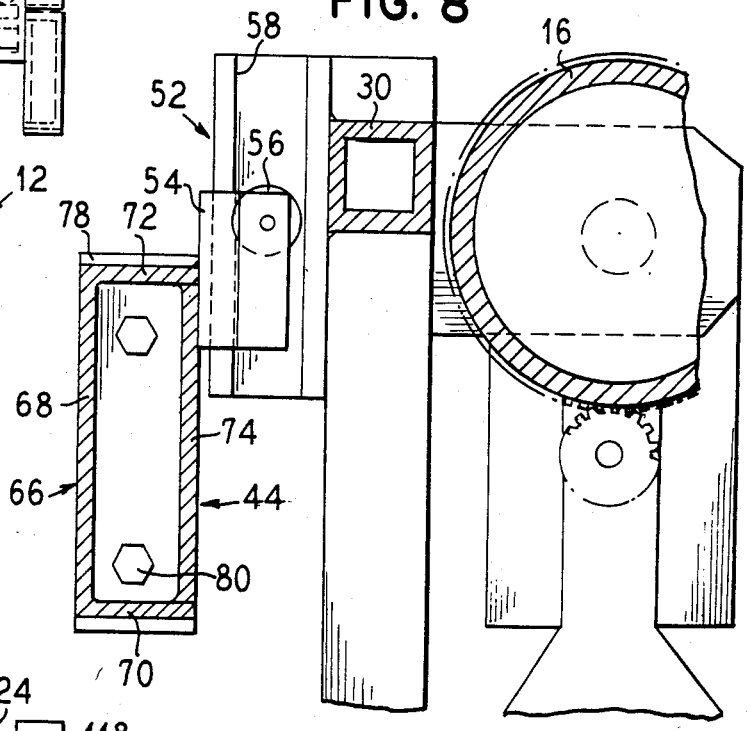
FIG. 8 is a partial side sectional view of an upper roller assembly taken generally along the lines of VIII—VIII of FIG. 2.
Figure 2:
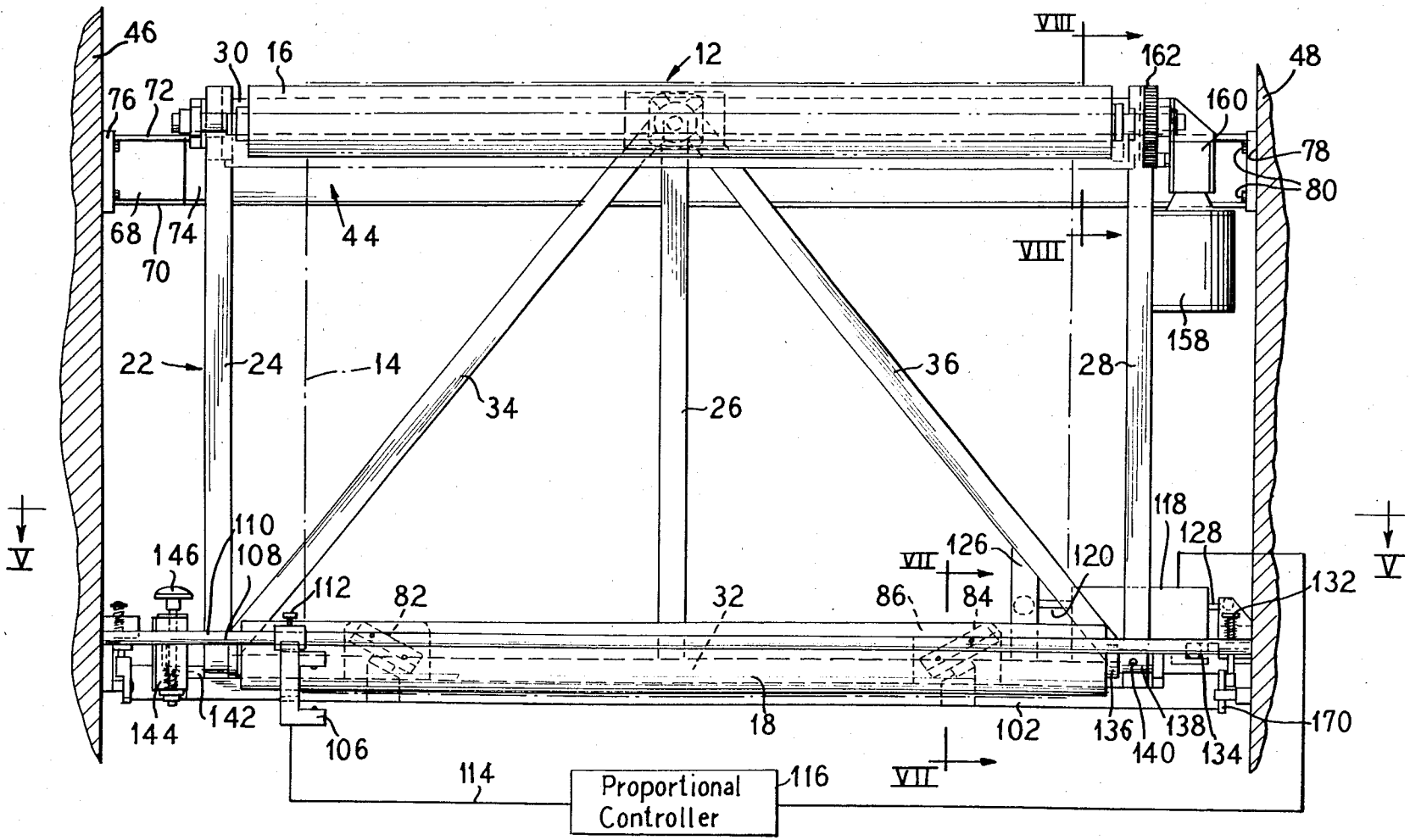
FIG. 2 is a front elevational view of a single pivot frame and associated apparatus.

As best seen in FIG. 8, the support bracket 44 is comprised of a channel member 66 having a tall vertical wall 68 and two shorter horizontal walls 70, 72. A stiffening and mounting plate 74 is secured to the open side of the channel 66 and the roller mounting block 54 is in turn secured to the stiffening and mounting wall 74 and the top horizontal wall 72. End plates 76, 78 are secured to either end of the channel 66 and appropriate fastening means such as bolts 80 secure the mounting plate 76, 78 to the stationary walls 46, 48. As seen in FIG. 2, the stiffening and mounting plate 74 does not extend the entire length of the channel 66 and therefor access is provided to the fastening means 80 for insertion and removal.

A bottom pair of roller assemblies 82, 84 is seen in FIGS. 2, 4 and 5 and one such roller assembly is shown in detail in FIG. 7.

In FIG. 7 it is seen that the bottom horizontal support member 32 carries a bracket 86 which has secured to it a channel or race member 88. The race member 88 may be removably secured to the bracket 86 by appropriate fastening means 90 such as bolts to allow for replacement of the race member 88 if it becomes worn. The race member 88 has a extending lip portion 92 which provides an interior race surface 94 which is to be engaged by a roller 96. The roller 96 is rotatably mounted on a roller carrying block 98 which is in turn secured to a mounting bracket 100. The mounting bracket is in turn secured to a relatively rigid support bar 102. The bottom paper roll 18 is mounted to the pivoting frame 22 by means of a mounting bracket 104 and the paper web 14 is carried on the roll 18 under tension between the roll 18 and the frame 22 thereby causing the race surface 94 to engage and press against the roller 96.

Thus, the pivot frame 22 is allowed to pivot about pivot pin 38 and is, at the same time, restrained from deviating from a vertical orientation. The roller assemblies provide for low friction movement of the pivot frame while ensuring vertical stability.

Figure 3:
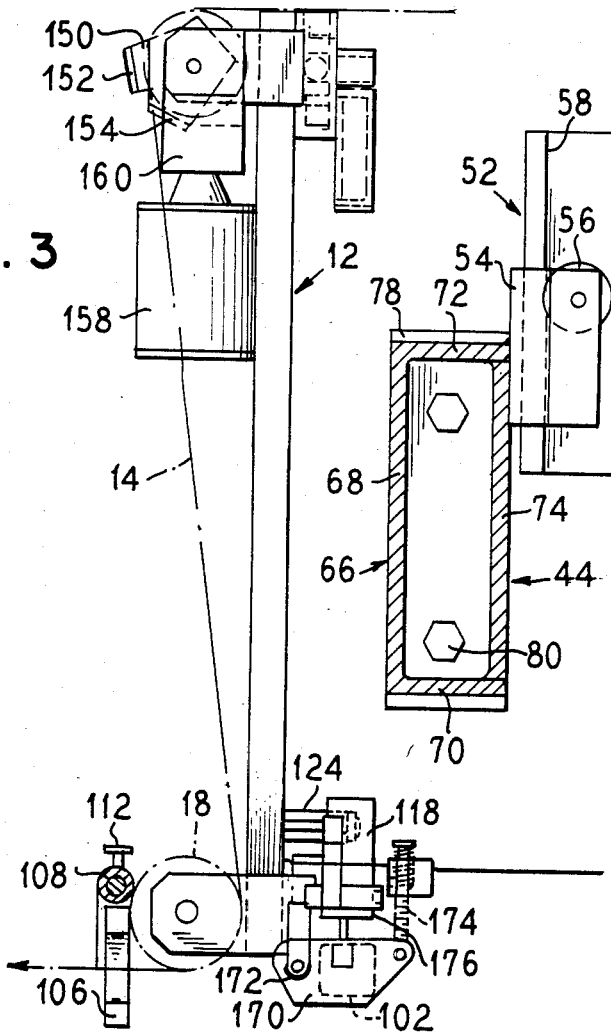
FIG. 3 is a side elevational view of the pivot frame shown in FIG. 2.

As seen in FIGS. 1, 2 and 3, after the web 14 leaves the bottom roller 18, it passes an edge sensor device 106 which is mounted on a cross bar 108 which is in turn secured to the stationary walls 46, 48. A flat surface 110 is provided in the cross bar 108 so that the edge detector 106 can be selectively moved and aligned depending on the desired position of the edge of the particular paper web being fed through the apparatus. A retaining device 112 is provided to secure the edge detector 106 in the desired and selected lateral position. A particular type of edge sensor 106 which can be utilized in the present invention is an infrared LED sensor which sends an error signal on electrical line 114 to a proportional controller 116 which controls an actuator 118.

The actuator 118 has a first extension arm 120 which is pivotally mounted at 122 to an extension arm 124 which is in turn secured to a mounting beam 126 which is a part of the frame 22. The mounting arm 126 extends between the lower horizontal support member 32 and the diagonal support member 36 as best seen in FIG. 2. A second extension arm 128 is pivotally mounted at 130 to a rigid and stationary mounting block 132 which in turn is secured to the stationary wall 48. When the extension arm of the actuator 118 is extended, the frame 22 will pivot around pivot pin 38 in a clockwise direction as seen in the view of FIG. 2. As the extension arm of the actuator 118 is retracted, the pivot frame 22 will pivot around pivot pin 38 in a counter-clockwise direction. Rubber snubbers 134 are provided for the actuator to absorb the torque reaction of the actuator 118 support it as it moves back and forth due to the extension and retraction of the actuator arm.

Thus, as the edge sensor 106 detects movement of the edge of the web 14 relative to the sensor, an error signal is sent through the proportional controller to the actuator to cause the frame 22 to pivot to cause the edge of the web 14 to move back to the desired position under the edge sensor.

The bottom roll 18 is mounted on a shaft 136 which is pivotally mounted at a first end 138 about a pivot pin 140 and at a second end 142 it is mounted in an adjustable spring loading device 144. The spring loading device 144 has an adjusting knob 146 which can be rotated to cause the second end 142 of the shaft 136 to move up or down relative to the pivoted first end 138. This adjustment provides the function of compensating for a paper web with a slack edge by increasing the relative web path length on the slack or baggy side. Because the movement of the roll is limited to the vertical plane and also because the edge sensor 106 is positioned downstream and adjacent to the adjustable roll 18, edge position is maintained with higher accuracy with this arrangement than is provided by previous configurations with a separate device for a slack edge adjustment.

Decurling of the paper web 14 can be accomplished by a decurling device 150 seen in FIGS. 3 and 4. The decurling device comprises a pair of slightly rounded bars 152, 154 which are secured at either end to an axle 156 of the top roll 16. Either bar can be rotated into the web 14 by means of an electric motor 158 and gear box 160 acting on a gear 162 to which the bars are mounted, to compensate for curl in either direction.

In FIG. 9 there is shown an alternative embodiment of a decurling apparatus 164 which comprises two bars 166, 168 selectively movable into the web 14 in varying degrees to automatically decurl the web. Such a decurling device is more fully described in our copending application directed to this feature.

As seen in FIG. 3, the support beam 102 to which the bottom set of roller assemblies 82, 84 are mounted, is mounted on a plate 170. The plate 170 is mounted in pivot bearings 172 at one side and at a second side has a spring loaded adjusting screw mounting 174. A load cell 176 is mounted on the side frame 46 to detect movement of the bracket around the pivot 172 and through such movement senses the tension of the web. The web tension creates a moment force about the pivots 172 which is resisted by and is proportional to the reaction against the load cell by the adjusting screw 174. The tension sensed is independent of the web position on the face of the roll 18 which is an improvement over previous load cell arrangements. Further, the incorporation of the web tension sensing apparatus as a part of the frame also lowers costs by eliminating a fixed supporting frame which is usually part of a pivoting edge guide.

As seen from the above disclosure and description, the incorporation of a web tensioning apparatus, a web decurling apparatus and a web guiding apparatus as a part of the pivoting frame provides for an improved apparatus for guiding and decurling webs of paper being directed to a high-speed sheeter. Several advantages are provided by use of the disclosed apparatus over prior art devices which use multiple separate and distinct apparatus.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A device for guiding webs of paper material to a high speed sheeter comprising:

a guide frame having a top horizontal roller over which the paper web passes and a bottom horizontal roller over which the paper web passes downstream of said top roller, a pair of spaced stationary side walls, a support bracket secured to said side walls, said guide frame pivotally mounted on said support brackets to pivot in a substantially vertical plane, means mounted between said walls downstream from and adjacent to said bottom roller for detecting the edge position of the paper web, said detecting means producing an error signal when the web's edge deviates from a desired position, means controlled by said error signal to cause said frame to pivot thereby moving said bottom roller to cause said web edge to return to the desired position, means mounted on said frame downstream of said top roller and upstream of said bottom roller for decurling the paper web as it passes through said frame, and means for sensing the tension of the paper web as it passes through said frame including a support bar, roller means carried on said support bar for engaging said frame to restrain said frame against movement other than pivotal movement about said pin, said support bar being pivotally mounted to said stationary walls to pivot in response to engagement force between said frame and said roller means, and means for measuring pivotal movement of said support bar.

2. The device of claim 1 wherein means are provided for selectively moving at least one end of said bottom roller relative to a corresponding end of said top roller to provide different path lengths between corresponding ends of said two rollers.

3. The device of claim 2 wherein said bottom roller is carried on a shaft which has one end pivotally mounted and a second end vertically adjustably mounted.

4. The device of claim 1 wherein said guide frame pivots about an axis of rotation which is perpendicular to and intersects an axis of rotation of said top roller.

5. The device of claim 1 wherein said detecting means comprises an infrared LED sensor mounted in line with said desired position.

6. The device of claim 1 wherein said means controlled by said error signal comprises an actuator having at least one extensible and retractable arm, one end of the actuator being connected to said frame and one end being pivotally supported by one of said stationary walls.

7. The device of claim 1 wherein said means for decurling comprises two slightly rounded bars, one on either side of the web, which may be selectively urged against the web to cause it to bend around said bars.

8. A device for guiding webs of paper material to a high speed sheeter comprising:

a guide frame having a top horizontal roller over which the paper web passes and a bottom horizontal roller over which the paper web passes downstream of said top roller, a pair of spaced stationary side walls, a support bracket secured to said side walls, said guide frame being orientated in a substantially vertical position and being pivotally mounted on a said support bracket to pivot in a substantially vertical plane with an axis of rotation of said frame perpendicular to and intersecting an axis of rotation of said top roller, said bottom roller carried on a shaft which is pivotally mounted at one end and is vertically adjustably mounted at a second end such that the roller can be selectively moved in and out of parallel relation to said upper roller thereby resulting in different path lengths between corresponding ends of said two rollers, means mounted between said walls downstream and adjacent to said bottom roller for detecting the edge position of the paper web, said detecting means producing an error signal when the web deviates from a desired position, means controlled by said error signal to cause said frame to pivot thereby moving said bottom roller to cause said web edge to return to the desired position, means mounted on said frame downstream of said top roller and upstream of said bottom roller for decurling the paper web as it passes through said frame, and means for sensing the tension of the paper web as it passes through said frame including a support bar, roller means carried on said support bar for engaging said frame to restrain said frame against movement other than pivotal movement about said pin, said support bar being pivotally mounted to said stationary walls to pivot in response to engagement force between said frame and said roller means, and means for measuring pivotal movement of said support bar.

9. The device of claim 8 wherein said detecting means comprises an infrared LED sensor mounted in line with said desired position.

10. The device of claim 8 wherein said means controlled by said error signal comprises an actuator having at least one extensible and retractable arm, one end of the actuator being connected to said frame and one end being pivotally connected to one of said stationary walls.

11. The device of claim 8 wherein said means for decurling comprises two slightly rounded bars, one on either side of the web, which may be selectively urged against the web to cause it to bend around said bars.

12. A device for guiding webs of paper material to a high speed sheeter comprising:

a pair of spaced stationary side walls, a support bracket secured to said side walls, a swing guide frame substantially vertically supported on a substantially horizontal pivot pin mounted on said support bracket, said guide frame having a top horizontal roller over which the paper web passes and a bottom roller over which the paper web passes downstream of said top roller, means mounted between said side walls downstream from and adjacent to said bottom roller for detecting the edge position of the paper web, said detecting means producing an error signal when the web's edge deviates from a desired position, means controlled by said error signal to cause said frame to pivot thereby moving said bottom roller to cause said web edge to return to the desired position, means mounted on said frame downstream of said top roller and upstream of said bottom roller for decurling the paper web as it passes through said frame, and means for sensing the tension of the paper web as it passes through said frame including a support bar, roller means carried on said support bar for engaging said frame to restrain said frame against movement other than pivotal movement about said pin, said support bar being pivotally mounted to said stationary walls to pivot in response to engagement force between said frame and said roller means, and means for measuring pivotal movement of said support bar.

* * * * *